US007097756B2

(12) United States Patent
Hesse et al.

(10) Patent No.: US 7,097,756 B2
(45) Date of Patent: Aug. 29, 2006

(54) METHOD FOR PRODUCING GOLD-COLORED SURFACES PERTAINING TO ALUMINUM OR ALUMINUM ALLOYS, BY MEANS OF FORMULATIONS CONTAINING SILVER SALT

(75) Inventors: Werner Hesse, Obrigheim (DE); Bernd Laubusch, Buerstadt (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 575 days.

(21) Appl. No.: 10/311,356

(22) PCT Filed: Jul. 10, 2001

(86) PCT No.: PCT/EP01/07936

§ 371 (c)(1),
(2), (4) Date: Jan. 8, 2003

(87) PCT Pub. No.: WO02/04717

PCT Pub. Date: Jan. 17, 2002

(65) Prior Publication Data

US 2003/0098240 A1 May 29, 2003

(30) Foreign Application Priority Data

Jul. 10, 2000 (DE) ..... 100 33 434

(51) Int. Cl.
*C25D 11/22* (2006.01)

(52) U.S. Cl. ..... 205/173; 205/213; 205/332

(58) Field of Classification Search ..... 205/173, 205/174

See application file for complete search history.

(56) References Cited

U.S. PATENT DOCUMENTS 4,128,460 A 12/1978 Nishimura et al.
4,478,692 A 10/1984 Nobel
5,587,063 A * 12/1996 Kuhm et al. ..... 205/173
6,251,249 B1 6/2001 Chevalier et al.

FOREIGN PATENT DOCUMENTS

| | | |
|---|---|---|
| BR | 9100174 | 9/1992 |
| BR | 9501255-9 | 5/1997 |
| BR | 9501280-0 | 5/1997 |
| DE | 38 24 402 | 1/1990 |
| DE | 42 44 021 | 6/1994 |
| EP | 0 351 680 | 1/1990 |
| JP | 55 131195 | 10/1980 |
| JP | 08 041676 | 2/1996 |
| JP | 11 181596 | 7/1999 |

* cited by examiner

*Primary Examiner*—Roy King
*Assistant Examiner*—William T. Leader
(74) *Attorney, Agent, or Firm*—Oblon, Spivak, McClelland, Maier & Neustadt, P.C.

(57) ABSTRACT

The invention relates to a process for obtaining gold-colored aluminum oxide layers in which the coloring of the oxidized surface of the aluminum or aluminum alloys is carried out by an electrolytic process in an electrolyte comprising an alkanesulfonic acid and an alkanesulfonate of silver, and to the use of the gold-colored workpieces based on aluminum or aluminum alloys produced by this process for decorative purposes.

The invention furthermore relates to an electrolyte solution for coloring the oxidized surface of aluminum or aluminum alloys gold by an electrolytic process, and to the use of an electrolyte comprising an alkanesulfonate of silver for coloring aluminum oxide layers based on aluminum or aluminum alloys gold in an electrolytic process.

8 Claims, No Drawings

METHOD FOR PRODUCING GOLD-COLORED SURFACES PERTAINING TO ALUMINUM OR ALUMINUM ALLOYS, BY MEANS OF FORMULATIONS CONTAINING SILVER SALT

The invention relates to a process for obtaining gold-colored aluminum oxide layers, to the use of silver salt-containing electrolytes for coloring aluminum oxide layers gold, to an electrolyte solution for coloring the oxidized surface of aluminum or aluminum alloys gold, and to the use of the gold-colored workpieces produced in accordance with the invention on the basis of aluminum or aluminum alloys.

Workpieces of aluminum or aluminum alloys are generally provided with a protective aluminum oxide layer for protection against corrosion and wear or for decorative reasons. Since aluminum oxide is colorless and the oxide layer is porous, a colorless aluminum oxide layer having a high absorption capacity is usually obtained. In order to obtain decorative surfaces, for example for building walls or visible components, these aluminum oxide layers are frequently colored.

The production of colored aluminum oxide layers is generally carried out in two steps. Firstly, the surface of the aluminum or aluminum alloy is oxidized. This oxide layer is subsequently colored by absorption of organic or inorganic dyes into the capillary-like pores of the oxide layer.

The surface oxidation of the aluminum surface or the aluminum alloy surface can be carried out chemically by dipping the workpieces into solutions of weakly attacking agents or by chromatization and phosphatization.

In general, however, anodic oxidation by electrochemical means (anodization, eloxal process) is more advantageous since thicker oxide coatings can be obtained in this way than by chemical treatment.

The most frequently used processes use sulfuric acid (S), oxalic acid (X) or chromic acid solutions as electrolytes. In the chromic acid process, exclusively direct current is used, while the sulfuric acid and oxalic acid processes are operated either with direct current (DS or DX process respectively) or with alternating current (AS or AX process respectively). It is also possible to employ a mixture of sulfuric acid and oxalic acid (DSX process). This has a certain relevance since the mixture can be employed at higher bath temperatures (22–24° C.) than pure sulfuric acid (18–22° C.). The layer thickness of the oxide layer in these processes is from about 10 to 30 μm. In some applications, particularly thin (a few μm in the case of belt anodization) of particularly thick (up to about 80 μm in the case of hard anodization) oxide layers are also produced.

Various processes are also known from the prior art for coloring the surface of aluminum or aluminum alloys subsequent to the oxidation of the surface. A distinction is usually made here between chemical and electrolytic coloring.

In the case of chemical coloring, anodized aluminum or aluminum alloy is colored in the aqueous phase using suitable organic or inorganic compounds without the action of current. Organic dyes (eloxal dyes, for example dyes from the alizarin series or indigo dyes) frequently have the disadvantage of poor light fastness. In the case of chemical coloring, inorganic dyes can be deposited in the pores by precipitation reactions or by hydrolysis of heavy-metal salts. However, the processes which take place are difficult to control, and problems frequently result with the reproducibility, i.e. in obtaining identical color shades. For this reason, the electrolytic processes have for some time increasingly prevailed for the coloring of aluminum oxide layers.

A number of electrolytic processes for the production of colored aluminum oxide layers are known from the prior art.

The most widespread is the electrolytic deposition of tin from acidic tin sulfate electrolytes containing throwing-improving additives. In this way, it is possible to obtain bronze hues which range from champagne-colored to virtually black.

U.S. Pat. No. 4,128,460 relates to a process for the coloring of aluminum or aluminum alloys by electrolysis, comprising the anodization of the aluminum or aluminum alloys using conventional methods and subsequent electrolysis in a bath comprising an aliphatic sulfonic acid and a metal salt, in particular a tin, copper, lead or silver salt, of the sulfonic acid. According to U.S. Pat. No. 4,128,460, an increase in the stability of the electrolysis bath is achieved by increased oxidation stability of the metal salts employed and uniform coloring of the surface of the aluminum or aluminum alloys is achieved. U.S. Pat. No. 4,128,460 indicates in Table 1 the hues obtained for various bath compositions, electrolysis voltages and electrolysis times. Thus, pale-bronze colorings of the aluminum oxide surface are obtained, for example, at a concentration of 10 g/l of tin methanesulfonate, based on the metal, in methanesulfonic acid at a voltage of 12 V and an electrolysis time of 5 minutes. At a concentration of 0.2 g/l of silver methanesulfonate and 10 g/l of tin methanesulfonate, in each case based on the metal, in methanesulfonic acid at a voltage of 15 V and an electrolysis time of 5 minutes, dark-brown colorings are obtained.

The Brazilian applications BR 91001174, BR 9501255-9 and BR 9501280-0 also relate to processes for the electrophoretic dip coloring of anodized aluminum using electrolytes and metal salts which are principally composed of pure methanesulfonic acid, methanesulfonates of tin or copper or methanesulfonates of nickel, lead or other salts. According to these applications, an increase in the specific electrical conductivity of the solution and a reduction in the time for the coloring are achieved in a simple manner and with reliable control and reproducibility of the same hues and low operating costs are achieved compared with the classical sulfate-based electrolytes and processes. These applications give no information on the hues of the colored aluminum oxide surface obtained by the processes according to the applications. Only BR 95011255-9 gives a general indication of the classical colors, such as bronze and wine red, in all their shades as far as deep black, which are usually obtained on use of metal salts, such as sulfates.

There is a demand for a wide range of colors for the coloring of aluminum oxide surfaces. In particular, colors such as gold, silver and white are of particular interest for decorative purposes. These colorings should be obtainable uniformly, and by very simple means and should be readily reproducible. In the case of silver, coloring of the aluminum surface is unnecessary since aluminum is itself silver colored.

EP-A 0 351 680 relates to the electrolytic coloring of anodically produced surfaces of aluminum and/or aluminum alloys in silver salt-containing, aqueous electrolytes by means of alternating current using p-toluenesulfonic acid. In this process, a gold coloration of the aluminum is obtained. The silver salt employed is preferably silver sulfate. The use of p-toluenesulfonic acid is crucial in order to obtain a warm, but reddish gold hue. If no p-toluenesulfonic acid is added, greenish colorings are obtained.

It is therefore an object of the present invention to provide a process for the production of gold-colored aluminum oxide surfaces. The process should give uniform and reproducible gold colorings, with the hue coming as close as possible to that of natural gold. Furthermore, very fast coloring should be facilitated without the addition of (environmentally harmful) additives, such as p-toluenesulfonic acid, being necessary.

We have found that this object is achieved by a process for obtaining gold-colored aluminum oxide layers which comprises the following steps:

a) pretreatment of aluminum or aluminum alloys;
b) anodic oxidation of the aluminum or aluminum alloys (anodization);
c) coloring of the oxidized surface of the aluminum or aluminum alloys by an electrolytic process in an electrolyte comprising an alkanesulfonic acid and an alkanesulfonate of silver;
d) subsequent treatment of the gold-colored workpiece obtained after a), b) and c);
e) if desired, recovery of the alkanesulfonic acid employed and/or its salts, it being possible for step e) to follow any step in which an alkanesulfonic acid is employed, in particular step b) and/or c) or to be carried out in parallel with these steps.

With the aid of the process according to the invention, gold-colored aluminum oxide layers are obtained which are distinguished by a uniform coloring and excellent quality of the surface, particularly with respect to light fastness and weathering resistance. The gold-colored workpieces obtained are ideally suitable for decorative purposes, for example for the production of window profiles and cladding components.

For the purposes of the present invention, the term alkanesulfonic acids is taken to mean aliphatic sulfonic acids. These may, if desired, be substituted on their aliphatic radical by functional groups or hetero atoms, for example hydroxyl groups. Preference is given to alkanesulfonic acids of the general formulae $$R—SO_3H \text{ or } HO—R'—SO_3H.$$

In these formulae, R is a hydrocarbon radical, which may be branched or unbranched, having 1 to 12 carbon atoms, preferably having 1 to 6 carbon atoms, particularly preferably an unbranched hydrocarbon radical having 1 to 3 carbon atoms, very particularly preferably having 1 carbon atom, i.e. methanesulfonic acid.

R' is a hydrocarbon radical, which may be branched or unbranched, having 2 to 12 carbon atoms, preferably having 2 to 6 carbon atoms, particularly preferably an unbranched hydrocarbon radical having 2 to 4 carbon atoms, where the hydroxyl group and the sulfonic acid group may be bonded to any desired carbon atoms, with the restriction that they are not bonded to the same carbon atom.

The alkanesulfonic acid employed in accordance with the invention is very particularly preferably methanesulfonic acid.

The process according to the invention can be used to color aluminum and aluminum alloys gold. Particularly suitable aluminum alloys are alloys of aluminum with silicon and/or magnesium. Silicon and/or magnesium may be present in the alloy in a proportion of 2% by weight (Si) or 5% by weight (Mg).

Step a)

The pretreatment of the aluminum or aluminum alloys is a crucial step since it determines the optical quality of the end product. Since the oxide produced during anodization is transparent and this transparency is also retained during the coloring process in step c), any surface flaw of the metallic workpiece remains visible as far as the finished part.

In general, the pretreatment is carried out by conventional processes, such as mechanical polishing and/or electropolishing, dewaxing using neutral surfactants or organic solvents, burnishing or pickling. In general, this is followed by rinsing with water. In a preferred embodiment of the present invention, alkanesulfonic acid-containing solutions are also employed in step a) (for example in the case of burnishing and electropolishing). Preferred alkanesulfonic acids have already been mentioned above. Particular preference is given to methanesulfonic acid.

Step b)

The anodization in step b) can be carried out by any process known from the prior art. The anodization is preferably carried out in sulfuric acid as electrolyte base.

In a further preferred process, the anodization is carried out in an electrolyte comprising from 3 to 30% by weight of an alkanesulfonic acid. The anodization is particularly preferably carried out in an electrolyte based on an alkanesulfonic acid or a mixture of an alkanesulfonic acid and another acid selected from sulfuric acid, phosphoric acid and oxalic acid. The electrolyte very particularly preferably comprises from 20 to 100 parts by weight of an alkanesulfonic acid and from 80 to 0 parts by weight of the other acid, where the sum of the alkanesulfonic acid and the other acid is 100 parts by weight and makes up a concentration of from 3 to 30% by weight of the electrolyte.

On use of alkanesulfonic acids based on the electrolyte employed in the anodization step, faster anodization takes place than in the case of the use of pure sulfuric acid. This is crucial in particular in respect of the subsequent coloring step c), since in the multistep process according to the invention, comprising anodization and subsequent coloring of the anodized surface, the anodization is the rate-determining step. This is, depending on the color of the surface, from 5 to 50 times slower than the subsequent coloring. By increasing the rate of the anodization step, more economic performance of the process is thus achieved, since higher throughputs per time unit can thus be achieved. Furthermore, the energy demand during anodization is also significantly reduced. Further details of this process are described in the application DE-A . . . with the title "Process for the surface treatment of aluminum or aluminum alloys by means of alkanesulfonic acid-containing formulations" submitted at the same time as this application.

In addition to the corresponding acid, preferably sulfuric acid or an alkanesulfonic acid or a mixture of various acids selected from alkanesulfonic acids, sulfuric acid, phosphoric acid or oxalic acid, the electrolyte generally also comprises water and, if necessary, further additives, such as aluminum sulfate.

The electrolysis time in order to achieve an aluminum oxide layer thickness of in general from 10 to 30 μm, preferably from 15 to 30 μm, which is optimum for a subsequent coloring step is generally from 10 to 60 minutes, preferably from 30 to 50 minutes, in an electrolytic process based on sulfuric acid and/or an alkanesulfonic acid, where the precise time is dependent, inter alia, on the current density.

The anodization of aluminum or aluminum alloys in step b) can be carried out either by the electrophoretic dip process or by continuous anodization, for example of belts, pipes or wires, by means of an electrolytic pull-through process, for example for the production of can sheeting.

The anodization can be operated either with direct current or with alternating current, but is preferably operated with direct current.

The anodization is preferably carried out at temperatures of from 17 to 24° C. If excessively high temperatures are used, irregular deposition of the oxide layer occurs, which is undesired. If an electrolyte based on an alkanesulfonic acid is employed, it is possible to carry out the anodization at temperatures of up to 30° C. Carrying out the process at elevated temperatures can save energy costs for cooling the electrolyte. Cooling of the electrolyte during the anodization is generally necessary since the anodization is exothermic.

In general, the anodization is carried out at a current density of from 0.5 to 5 A/dm$^2$, preferably from 0.5 to 3 A/dm$^2$, particularly preferably from 1.0 to 2.5 A/dm$^2$. The voltage is generally from 1 to 30 V, preferably from 2 to 20 V.

Suitable devices for carrying out the anodization are generally all known devices which are suitable for electrophoretic dip coating of continuous anodic oxidation of aluminum or aluminum alloys, for example by means of an electrolytic pull-through process.

Step c)

After the anodization in step b), the resultant aluminumoxide layer is in accordance with the invention colored gold. This gold coloring is achieved in an electrolyte comprising an alkanesulfonate of silver and an alkanesulfonic acid. Gold-colored aluminum workpieces of this type are of particular interest for the production of decorative objects since the demand for gold-colored objects made of aluminum is great.

These gold-colored aluminum oxide surfaces are preferably obtained by carrying the coloring in step c) at a concentration of the silver salt, calculated as $Ag^+$, of from 2 to 50 g/l, preferably from 3 to 20 g/l, and a product of current density and voltage of from 0.5 to 10 AV/dm$^2$, preferably from 1 to 5 AV/dm$^2$, over a period of in general from 0.05 to 4 minutes, preferably from 0.3 to 3 minutes, particularly preferably from 0.5 to 2 minutes. Precise matching of the three parameters concentration of the silver salt, product of current density and voltage and electrolysis time is crucial here. A deviation of only one parameter results in undesired colorings. Furthermore, a relatively high concentration of the silver salt, calculated as $Ag^+$, of from 2 to 50 g/l is employed. Only at high silver salt concentrations is a green cast of the gold-colored layers avoided. Such high silver salt concentrations can only be achieved using a readily soluble salt, an alkanesulfonic acid salt in accordance with the present invention. Silver sulfate is therefore not suitable since its solubility limit in water is about 0.9 g/l. Due to the better solubility of the alkanesulfonates, automatic metering of the silver salt in liquid form, i.e. in solution, is furthermore facilitated. Furthermore, in addition, higher silver salt concentrations enable faster deposition to be achieved on the aluminum oxide surface.

The aluminum oxide layers obtained after step b) of the process according to the invention are colored in a metal salt-containing electrolyte by means of direct or alternating current, preferably by means of alternating current. During this operation, metal is deposited from the metal salt solution on the pore base of the oxide layer. The gold color achieved by means of the process according to the invention is very light-fast. A uniform and readily reproducible hue is achieved.

In the electrolyte in step c), an acid is preferably employed which is selected from an alkanesulfonic acid or a mixture of an alkanesulfonic acid and sulfuric acid.

In a particularly preferred embodiment of the process according to the invention, the silver salt-containing electrolyte comprises from 20 to 100 parts by weight of an alkanesulfonic acid and from 80 to 0 parts by weight of sulfuric acid, where the sum of alkanesulfonic acid and sulfuric acid is 100 parts by weight and makes up a concentration of from 0.1 to 20% by weight, preferably from 1 to 15% by weight, of the electrolyte. The electrolyte very particularly preferably comprises 100 parts by weight of an alkanesulfonic acid. The electrolytes according to the present invention are aqueous electrolytes.

Alkanesulfonic acids which are suitable for the process in step c) have already been disclosed above. Particular preference is given to methanesulfonic acid.

Compared with electrolytes based purely on sulfuric acid, electrolytes based on alkanesulfonic acids have higher electrical conductivity, result in faster coloring, and exhibit a reduced oxidation action, thus preventing the precipitation of metal salts from the metal salt-containing electrolyte. Addition of additives, such as environmentally harmful phenol- or toluenesulfonic acid, or similar additives in order to increase the bath stability and improve the throwing or to avoid a green cast of the gold coloration is unnecessary.

Furthermore, faster coloring than in the case of the use of pure sulfuric acid is achieved on use of alkanesulfonic acids in the electrolyte. Furthermore, reproducible gold colorations are achieved, ensuring uniform product quality. In addition, the throwing-improving action of alkanesulfonic acids should be emphasized, which results in uniform deposition of the metal salts employed and thus in very good surface quality.

In addition to the silver salts employed in accordance with the invention, other suitable metal salts are generally salts selected from tin, copper, cobalt, nickel, bismuth, chromium, palladium and lead or mixtures of two or more of these metal salts. The silver salt-containing electrolytes in step c) can preferably comprise copper salts and/or tin salts in addition to silver salts, which allows the gold hue to be varied in fine nuances.

The copper salts and/or tin salts which may be present in the electrolyte are preferably alkanesulfonates and/or sulfates. Particular preference is given to alkanesulfonates.

For the purposes of the present invention, the term alkanesulfonates is taken to mean aliphatic sulfonates. These may, if desired, be substituted on their aliphatic radical by functional groups or hetero atoms, for example hydroxyl groups. Preference is given to alkanesulfonates of the general formulae $$R—SO_3^- \text{ or } HO—R'—SO_3^-.$$

In these formulae, R is a hydrocarbon radical, which may be branched or unbranched, having 1 to 12 carbon atoms, preferably having 1 to 6 carbon atoms, particularly preferably an unbranched hydrocarbon radical having 1 to 3 carbon atoms, very particularly preferably having 1 carbon atom, i.e. methanesulfonate.

R' is a hydrocarbon radical, which may be branched or unbranched, having 2 to 12 carbon atoms, preferably having 2 to 6 carbon atoms, particularly preferably an unbranched hydrocarbon radical having 2 to 4 carbon atoms, where the hydroxyl group and the sulfonate group may be bonded to any desired carbon atoms, with the restriction that they are not bonded to the same carbon atom.

The silver salt employed in the process according to the invention is very particularly preferably silver methanesulfonate.

In addition to the corresponding acid, an alkanesulfonic acid or a mixture of a sulfuric acid and an alkanesulfonic acid and the alkanesulfonate of silver employed and optionally further metal salts, the electrolyte generally comprises water and, if necessary, further additives, such as aromatic sulfonic acids for improving throwing. If an alkanesulfonic acid, in particular methanesulfonic acid, is employed as acid, additives for improving throwing can generally be omitted.

All devices which are suitable for electrolytic coloring of aluminum oxide layers can be used.

Suitable electrodes are the electrodes which are usually suitable in a process for the electrolytic coloring of aluminum oxide layers, such as stainless-steel or graphite electrodes. It is also possible to employ silver electrodes or electrodes made from one of the further metals that may be employed, which dissolve during the electrolysis and thus replenish the corresponding metal salt during the electrolysis.

Step d)

The subsequent treatment of the workpiece obtained after step c) or, where appropriate, additionally obtained after step b) is divided into two steps:

d1) Rinsing

In order to remove bath residues from the pores of the oxide layer, the workpieces are generally rinsed with water, in particular with running water. This rinsing step follows either step b) or step c).

d2) Sealing

The pores of the resultant oxide layer are generally sealed after step c) in order to obtain good corrosion protection. This sealing can be achieved by dipping the workpieces into boiling, distilled water for about 30 to 60 minutes. The oxide layer swells during this operation, causing the pores to become closed. The water may also contain additives. In a particular embodiment, the workpieces are subsequently treated in live steam of from 4 to 6 bar instead of in boiling water.

Further sealing processes are possible, for example by dipping the workpieces into a solution of readily hydrolyzable salts, where the pores are blocked by low-solubility metal salts, or into chromate solutions, which is predominantly used for silicon- and heavy-metal-rich alloys. Treatment in dilute water-glass solutions also results in sealing of the pores if the silicic acid is precipitated by subsequent dipping into sodium acetate solution. It is possible to seal the pores by insoluble metal silicates or by organic, water-repellent substances, such as waxes, resins, oils, paraffins, coatings and plastics.

However, the sealing is preferably carried out by means of water or steam.

e) Recovery of the Alkanesulfonic Acid Employed and/or Its Salts

In order to save costs and for ecological reasons, the alkanesulfonic acid employed and/or its salts can be recovered. This recovery can follow each step in which an alkanesulfonic acid can be employed or can be carried out in parallel to these steps. Recovery is possible, for example, together with the rinsing step (d1)) following step b) and step c). A recovery of this type can be carried out, for example, by means of electrolytic membrane cells, by cascade rinsing or by simple concentration, for example of the rinsing solutions.

The present invention furthermore relates to the use of an electrolyte comprising an alkanesulfonate of silver for coloring aluminum oxide layers based on aluminum or aluminum alloys gold in an electrolytic process. The invention furthermore relates to an electrolyte solution for coloring the oxidized surface of aluminum or aluminum alloys gold by an electrolytic process, comprising an alkanesulfonate of silver, if desired together with copper salts and/or tin salts, and an acid selected from an alkanesulfonic acid or a mixture of an alkanesulfonic acid and sulfuric acid. It was hitherto not disclosed in the prior art that silver alkanesulfonates, preferably silver methanesulfonate, if desired together with further metal salts, preferably tin salts and copper salts, are suitable for coloring aluminum oxide layers gold. Through the use of alkanesulfonates of silver and the use of electrolytes comprising an alkanesulfonate of silver for coloring aluminum oxide surfaces gold, uniform and reproducible gold-colored aluminum oxide surfaces can be produced in a short time.

The present invention furthermore relates to the use of the gold-colored workpieces based on aluminum or aluminum alloys produced by the process according to the invention for decorative purposes.

These gold-colored workpieces based on aluminum or aluminum alloys can be used everywhere where aluminum workpieces are employed in externally visible locations. Examples of uses of the gold-colored aluminum workpieces produced in accordance with the invention are in the construction industry, in particular for the production of window profiles or cladding components, and for handles of all types, fittings and coverings, for the production of domestic articles, in automobile or aircraft construction, in particular for body and interior parts, and in the packaging industry.

The examples below explain the invention additionally.

EXAMPLES

Example 1

Degreased and pickled sheets of the aluminum alloy $AlMgSi_{0.5}$ were anodized for 40 minutes at 16 V and 1.5 A/dm$^2$ by the DS process at 20° C. in 18% $H_2SO_4$ with addition of 8 g/l of Al, giving an oxide layer with a thickness of approximately 20 μm. A coloring electrolyte was prepared from 1.9 g/l of silver methanesulfonate (corresponding to 1 g/l of $Ag^+$) and 57 g/l of methanesulfonic acid. At current densities of 0.2, 0.4 and 2 A/dm$^2$ and a voltage of about 8 V, anodized sheets were colored for different lengths of time. Table 1 below shows the colors obtained as a function of time:

TABLE 1

| Time [sec] | Color at 0.2 A/dm$^2$ | Color at 0.4 A/dm$^2$ | Color at 2 A/dm$^2$ |
|---|---|---|---|
| 15 | Light pale gold[1)] | Pale gold[1)] | Greenish gold |
| 30 | [1)] | [1)] | Dark gold |
| 60 | [1)] | Gold[1)] | Pale brown |
| 120 | [1)] | [1)] | Brown (olive east) |
| 180 | Gold[1)] | Dark gold[1)] | Dark brown |

[1)]greenish

Example 2

The procedure was as in Example 1, but the coloring electrolyte was prepared from 19 g/l of Ag MSA (MSA=methanesulfonic acid) (10 g/l of $Ag^+$) and 57 g/l of MSA.

Table 2 below shows the colors obtained as a function of time:

| Time [sec] | Color at 0.2 A/dm$^2$ | Color at 0.4 A/dm$^2$ | Color at 2[1)] A/dm$^2$ |
|---|---|---|---|
| 15 | Pale gold | Light gold | Reddish gold |
| 30 | Light gold | Gold | Dark red-gold |
| 60 | Gold | Dark gold | Wine red |
| 120 | Gold | Pale brown | Red-black |
| 180 | Dark gold | Red-brown | Black |

[1)]Comparative experiment

Example 3

The procedure was as in Examples 1 and 2, but the coloring electrolyte was prepared from 19 g/l of Ag MSA (10 g/l of $Ag^+$), 5 g/l of Cu MSA (2 g/l of $Cu^{2+}$) and 57 g/l of MSA. The coloring was carried out at 0.2 A/dm$^2$. After only 45 seconds, an attractive gold coloration was achieved which differs in slight nuances from the gold hues from Example 2.

We claim:

1. A process for obtaining gold-colored aluminum oxide layers which comprises the following steps:

a) pretreatment of aluminum or aluminum alloys;

b) anodic oxidation of the aluminum or aluminum alloys (anodization);

c) coloring of the oxidized surface of the aluminum or aluminum alloys by an electrolytic process in an electrolyte comprising an alkanesulfonic acid and an alkanesulfonate of silver;

d) subsequent treatment of the gold-colored workpiece obtained after a), b) and c);

e) if desired, recovery of the alkanesulfonic acid employed and/or its salts, it being possible for step e) to follow any step in which an alkanesulfonic acid is employed, in particular step b) and/or c) or to be carried out in parallel with these steps, wherein the coloring in step c) is carried out at a concentration of the alkanesulfonate of silver of from 2 to 50 g/l and a product of current density and voltage of from 0.5 to 10 AV/dm$^2$ over a period of from 0.05 to 4 minutes.

2. A process as claimed in claim 1, wherein, in the electrolyte in step c), an acid is employed which is selected from an alkanesulfonic acid or a mixture of an alkanesulfonic acid and sulfuric acid.

3. A process as claimed in claim 1, wherein the electrolytes comprising an alkanesulfonate of silver in step c) may comprise copper salts and/or tin salts in addition to the alkanesulfonate of silver.

4. A process as claimed in claim 3, wherein the copper salts and/or tin salts which may be present in the electrolyte are alkanesulfonates and/or sulfates.

5. A process as claimed in claim 1, wherein the alkanesulfonic acid is methanesulfonic acid.

6. A process as claimed in claim 1, wherein the anodic oxidation in step b) is carried out in an electrolyte based on an alkanesulfonic acid or a mixture of an alkanesulfonic acid and a further acid selected from sulfuric acid, phosphoric acid and oxalic acid.

7. A process as claimed in claim 1, wherein alkanesulfonic acid-containing solutions are employed in the pretreatment of the aluminum or aluminum alloys in step a).

8. An electrolytic process for coloring aluminum oxide layers based on aluminum or aluminum alloys gold, wherein the coloring is carried out at a product of current density and voltage of from 0.5 to 10 AV/dm$^2$ over a period of from 0.05 to 4 minutes in an electrolyte comprising an alkanesulfonate of silver in a concentration of from 2 to 50 g/l.

* * * * *